US012557928B2

(12) United States Patent
Mizuno et al.

(10) Patent No.: US 12,557,928 B2
(45) Date of Patent: Feb. 24, 2026

(54) CUSHION MEMBER AND METHOD FOR MANUFACTURING THE SAME

(71) Applicant: airweave inc., Aichi (JP)

(72) Inventors: Akira Mizuno, Aichi (JP); Yusuke Hayashi, Aichi (JP)

(73) Assignee: airweave inc., Aichi (JP)

( * ) Notice: Subject to any disclaimer, the term of this patent is extended or adjusted under 35 U.S.C. 154(b) by 321 days.

(21) Appl. No.: 18/035,110

(22) PCT Filed: Oct. 13, 2021

(86) PCT No.: PCT/JP2021/037855

§ 371 (c)(1),
(2) Date: Jun. 7, 2023

(87) PCT Pub. No.: WO2022/097435

PCT Pub. Date: May 12, 2022

(65) Prior Publication Data

US 2024/0008664 A1 Jan. 11, 2024

(30) Foreign Application Priority Data

Nov. 4, 2020 (JP) ..... 2020-184358

(51) Int. Cl.

| | |
|---|---|
| ***A47G 9/10*** | (2006.01) |
| ***D04H 3/018*** | (2012.01) |
| ***D04H 3/16*** | (2006.01) |

(52) U.S. Cl.

CPC ..... *A47G 9/1081* (2013.01); *D04H 3/018* (2013.01); *D04H 3/16* (2013.01)

(58) Field of Classification Search

CPC ..... A47G 9/10; A47G 9/1009; A47G 9/1027; A47G 9/1036; A47G 9/1045;

(Continued)

(56) References Cited

U.S. PATENT DOCUMENTS

| | | | | |
|---|---|---|---|---|
| 6,513,179 | B1 * | 2/2003 | Pan | A47G 9/109 5/636 |
| 2013/0189472 | A1 * | 7/2013 | Takaoka | D04H 3/07 264/178 F |

(Continued)

FOREIGN PATENT DOCUMENTS

| | | |
|---|---|---|
| JP | 3103115 | 7/2004 |
| JP | 2005066134 | 3/2005 |

(Continued)

OTHER PUBLICATIONS

"International Search Report (Form PCT/ISA/210) of PCT/JP2021/037855", mailed on Nov. 22, 2021, with English translation thereof, pp. 1-4.

*Primary Examiner* — George Sun
(74) *Attorney, Agent, or Firm* — JCIPRNET

(57) ABSTRACT

A cushion member is provided which can stabilize a head position while sinking a head moderately. The cushion member is a cushion member for a pillow which is formed using a filament three-dimensional bonded member obtained by three-dimensionally fusing filaments formed of a thermoplastic resin, in a width direction, repulsive forces in regions on the sides of both end portions are higher than a repulsive force in the region of a center portion and in a depth direction, repulsive forces in regions on the sides of both end portions are higher than a repulsive force in the region of a center portion.

3 Claims, 9 Drawing Sheets

(58) Field of Classification Search
CPC .. A47G 9/1054; A47G 9/1063; A47G 9/1072; A47G 9/1081; A47G 9/109; A47G 2009/1018; D04H 3/018; D04H 3/16
See application file for complete search history.

(56) References Cited

U.S. PATENT DOCUMENTS

| | | | | |
|---|---|---|---|---|
| 2016/0174725 | A1* | 6/2016 | Takaoka | A47C 27/006 5/652.1 |
| 2018/0147792 | A1* | 5/2018 | Kojima | B33Y 40/00 |
| 2019/0125092 | A1* | 5/2019 | Ando | D04H 3/16 |
| 2020/0315365 | A1* | 10/2020 | Kondo | B32B 5/262 |
| 2021/0054549 | A1* | 2/2021 | Takaoka | A61G 7/065 |

FOREIGN PATENT DOCUMENTS

| | | |
|---|---|---|
| JP | 2017226230 | 12/2017 |
| WO | 2018150815 | 8/2018 |

* cited by examiner

CUSHION MEMBER AND METHOD FOR MANUFACTURING THE SAME

CROSS-REFERENCE TO RELATED APPLICATION

This application is a 371 application of the International PCT application serial no. PCT/JP2021/037855, filed on Oct. 13, 2021, which claims the priority benefit of Japan Patent Application No. 2020-184358, filed on Nov. 4, 2020. The entirety of each of the above-mentioned patent applications is hereby incorporated by reference herein and made a part of this specification.

TECHNICAL FIELD

The present invention relates to a cushion member which supports the head of a user in a sleeping posture and a method for manufacturing the cushion member.

BACKGROUND ART

Conventionally, bedding and the like which use a cushion member for elastically supporting a user are utilized, and one example is a pillow in which a cushion member is formed to support the head of a user in a sleeping posture. Various materials for the cushion member as described above have also been developed.

For example, patent documents 1 and 2 disclose a filament three-dimensional bonded member obtained by three-dimensionally fusing filaments formed of a thermoplastic resin and a method for manufacturing the filament three-dimensional bonded member. The filament three-dimensional bonded member has a high repulsive force so as not to lose its shape easily, has satisfactory air permeability and is, for example, easy to wash with water, and thus the filament three-dimensional bonded member is excellent in that it can be used cleanly.

RELATED ART DOCUMENT

Patent Document

Patent Document 1: International Patent Publication No. 2018/150815

DISCLOSURE OF THE INVENTION

Problems to be Solved by the Invention

Although in order for a user to feel comfortable in bed, it is important to stabilize the head position of the user in a sleeping posture, when a filament three-dimensional bonded member obtained by three-dimensionally fusing filaments formed of a thermoplastic resin is used as a cushion material for a pillow, the filament three-dimensional bonded member has a high repulsive force, with the result that the head position (the inclination of the head) is disadvantageously unstable. Hence, as a cushion member for a pillow, a cushion member is desired which can stabilize the head position while sinking the head moderately.

In view of the problem described above, an object of the present invention is to provide a cushion member which can stabilize a head position while sinking a head moderately and a method for manufacturing the cushion member.

Means for Solving the Problem

A cushion member according to the present invention is a cushion member for a pillow which is formed using a filament three-dimensional bonded member obtained by three-dimensionally fusing filaments formed of a thermoplastic resin, in a width direction, repulsive forces in regions on sides of both end portions are higher than a repulsive force in a region of a center portion, and in a depth direction, repulsive forces in regions on sides of both end portions are higher than a repulsive force in a region of a center portion. In the configuration described above, the shape of the cushion member is unlikely to be lost, satisfactory air permeability is achieved, cleanliness is not impaired and while a head is being sunk moderately, the head position can be stabilized.

More specifically, in the configuration described above, at least two types of cushion portions may include: a cushion portion in which in a width direction, repulsive forces in regions on sides of both end portions are higher than a repulsive force in a region of a center portion; and a cushion portion in which in a depth direction, repulsive forces in regions on sides of both end portions are higher than a repulsive force in a region of a center portion, and the at least two types of cushion portions may be stacked in layers in an up-down direction.

More specifically, in the configuration described above, the cushion member may be formed by inserting a second cushion portion into a first cushion portion which is formed in a substantially tubular shape.

A manufacturing method according to the present invention is a method for manufacturing the cushion member configured as described above of the filament three-dimensional bonded member, the method includes: a molten filament supply processing step of discharging a molten filament group downward from a plurality of openings in a nozzle portion; and a fusing formation processing step of cooling and fusing the molten filament group discharged and drawing a bonded member obtained by the fusing in a transport direction and the diameter or the density of the openings is changed in each of different regions of the nozzle portion and the speed of the drawing is changed at a predetermined time interval such that a repulsive force is changed in each of different regions of the cushion member.

Advantages of the Invention

With a pillow based on the present invention, it is possible to stabilize a head position while sinking a head moderately.

DESCRIPTION OF EMBODIMENTS

Figure 1:
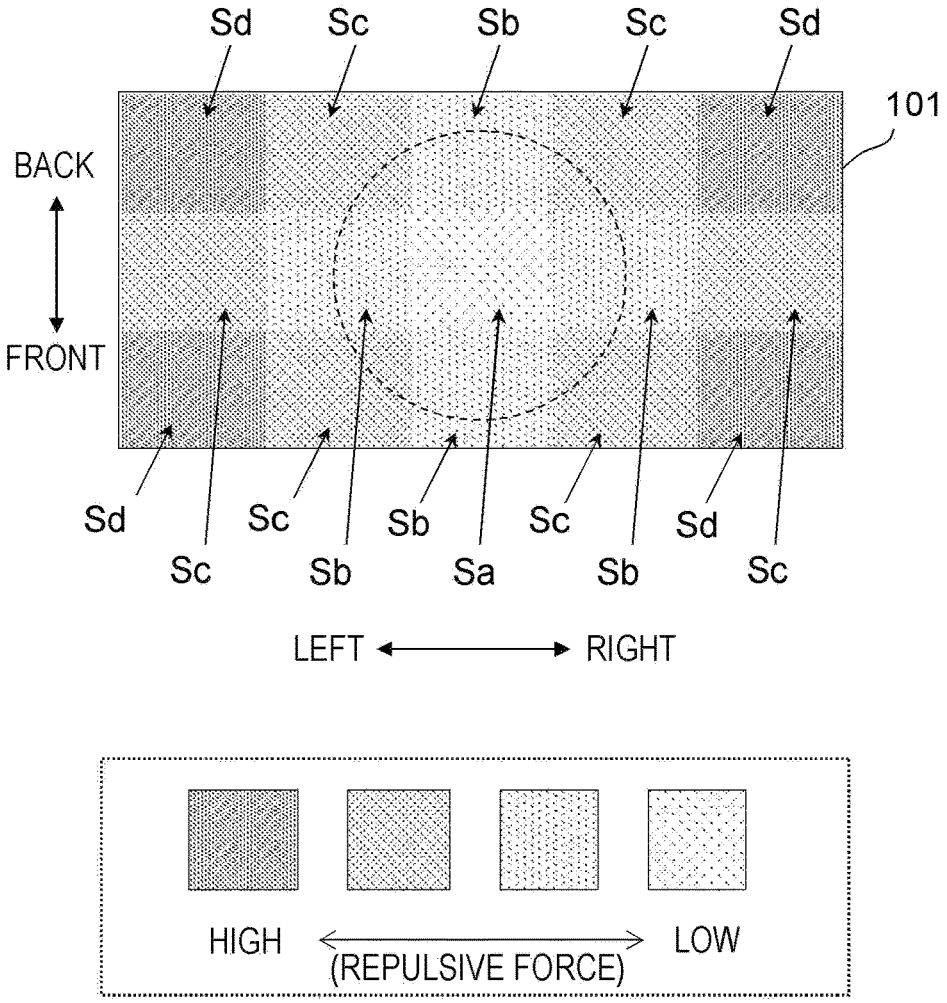
FIG. 1 is a schematic plan view of a cushion member according to a first embodiment.
Figure 2:
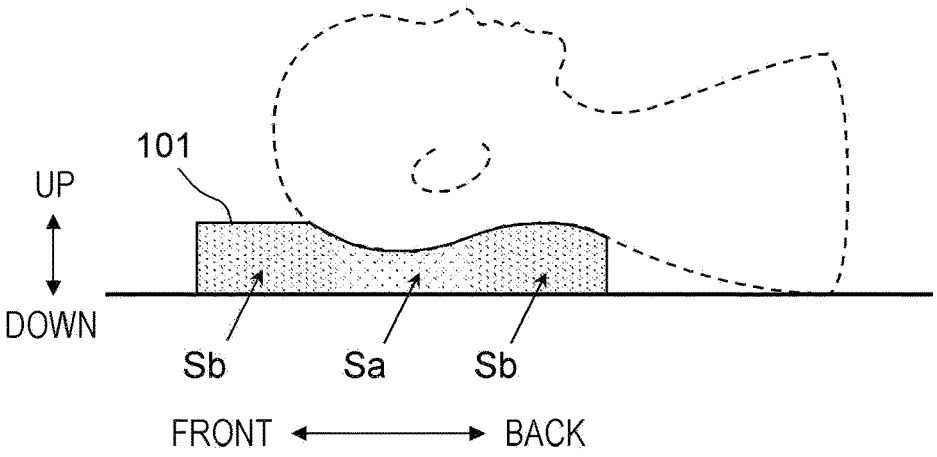
FIG. 2 is a schematic cross-sectional view of the cushion member according to the first embodiment.

Embodiments of the present invention will be described below with reference to drawings. For a cushion member for a pillow, an up-down direction (height direction), a left/right direction (width direction) and a forward/backward direction (depth direction) (which are orthogonal to each other) are as shown in FIG. 1 and the like. As shown in FIG. 2, the depth direction for the pillow coincides with a height direction for a user in a supine sleeping posture, and the width direction for the pillow coincides with a left/right direction for the user.

1. First Embodiment

The first embodiment of the present invention will first be described. FIG. 1 is a schematic plan view (diagram viewed from above) of a cushion member for a pillow 101 according to the first embodiment, and FIG. 2 is a cross-sectional view of the cushion member 101 taken along a plane which divides the cushion member 101 into two equal portions in the left/right direction. The cushion member 101 is formed to support the head of the user in a sleeping posture. A broken line shown in FIG. 1 indicates a schematic position of the head of the user. The cushion member 101 is formed substantially in the shape of a rectangle in which a left/right direction is a longitudinal direction in plan view, and a center region of the upper surface is mainly used to support the head. The cushion member 101 may be used as a pillow in a state where the cushion member 101 is covered with an unillustrated pillow cover.

The cushion member 101 is a filament three-dimensional bonded member obtained by three-dimensionally fusing filaments formed of a thermoplastic resin. In the filament three-dimensional bonded member, a repulsive force can be increased by thickening the filaments thereof (increasing the diameter of the filaments) or increasing the number of filaments per unit volume (increasing the density of the filaments).

In the cushion member 101, in the left/right direction, repulsive forces in regions on the sides of both end portions are higher than a repulsive force in the region of a center portion, and in the forward/backward direction, repulsive forces in regions on the sides of both end portions are higher than a repulsive force in the region of a center portion. More specifically, in the cushion member 101, as indicated by a colored state in FIG. 1, the arrangement pattern of repulsive forces (relationship between regions divided in plan view and repulsive forces) is set. In FIG. 1 (the same is true for FIGS. 2, 5 to 8 and 10 described later), the darker the color, the higher the repulsive force. The repulsive force of the cushion member 101 is substantially uniform in the up-down direction.

The cushion member 101 is divided into five equal portions in the left/right direction and is divided into three equal portions in the forward/backward direction so as to be divided into a total of 15 regions, and a center region thereof is set to a region Sa which has the lowest repulsive force. The four regions adjacent to the region Sa in the forward/backward direction and in the left/right direction are set to regions Sb which have a higher repulsive force than the region Sa. Furthermore, the four regions in four corners are set to regions Sd which have the highest repulsive force. The remaining six regions are set to regions Sc which have a higher repulsive force than the regions Sb and a lower repulsive force than the regions Sd. Although the repulsive force of the cushion member in the present embodiment is changed in three stages from a center to each of both left and right ends, and is changed in two stages to each of both front and back ends in plan view, the present invention is not particularly limited to how many stages the repulsive force is changed in.

As described above, the cushion member 101 is formed such that the repulsive force is set low in the center region in plan view, and thus the head of the user can be sunk moderately. On the other hand, in the cushion member 101, the repulsive forces in the regions on the sides of both end portions in the left/right direction and the regions on the sides of both end portions in the forward/backward direction are higher than the repulsive force in the center region in plan view, and accordingly, in the regions on the sides of both end portions in the left/right direction and the regions on the sides of both end portions, the head is unlikely to be sunk. In this way, the head position of the user can be stabilized as much as possible in a position near the center of the cushion member 101 in plan view, and thus the user can sleep comfortably. Furthermore, the temporal portion of the user in a side lying position can be supported by the regions on the sides of both end portions in the left/right direction and the regions on the sides of both end portions in the forward/backward direction, and thus it is possible to suppress excessive sinking of the head as much as possible. In the cushion member 101, in a supine position, the height of the pillow in a position where the back of the head is supported and the height of the pillow in a position where the cervical spine is supported can be freely changed, and thus the jaws are prevented from being pulled in the supine position, with the result that the user can sleep in a posture close to a natural posture. The height of the pillow on the sides of both end portions in the left/right direction and the height of the pillow on the sides of both end portions in the forward/backward direction can be freely changed, and thus the user in the side lying position can sleep in a posture close to a natural posture. Although in general, the cushioning property of the peripheral edge of the cushion member is relatively easily deteriorated by a load, in the present embodiment, the head is prevented from being moved onto the peripheral edge of the cushion member as much as possible, with the result that the cushion member is unlikely to be deteriorated.

As shown in FIG. 2, the repulsive force in the region Sb on the back side of the cushion member 101 is higher than the repulsive force in the center region Sa. Hence, in the cushion member 101, an area around the cervical spine of the user can be supported by the part having a relatively high repulsive force, and thus excessive sinking of the head is suppressed, with the result that the user can sleep comfortably.

2. Second Embodiment

The second embodiment of the present invention will then be described. In the following description, emphasis is placed on the description of items different from the first embodiment, and description of items common to the first embodiment may be omitted.

Figure 3A:
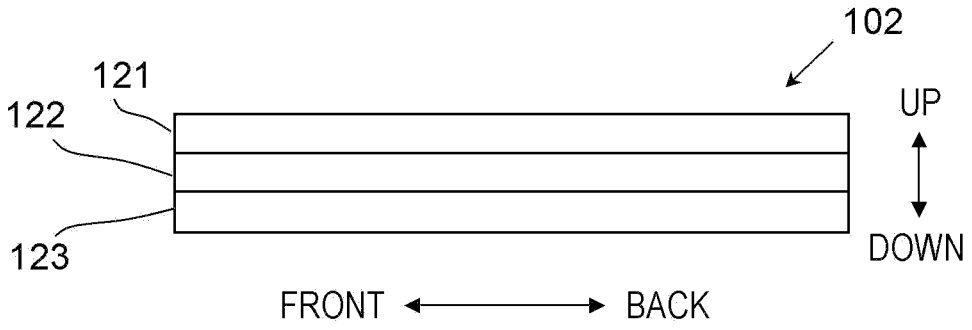
FIG. 3A is a schematic front view of a cushion member according to a second embodiment.
Figure 4:
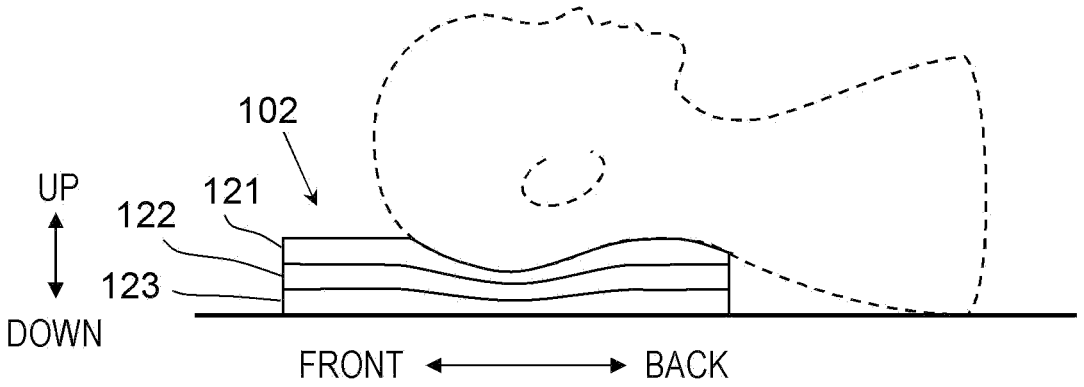
FIG. 4 is a schematic cross-sectional view of the cushion member according to the second embodiment.

FIG. 3A is a schematic front view of a cushion member for a pillow 102 according to the second embodiment, and FIG. 4 is a cross-sectional view of the cushion member 102 taken along a plane which divides the cushion member 102 into two equal portions in the left/right direction. The cushion member 102 is formed to support the head of the user in a sleeping posture, and is mainly used to support the head with a center region of the upper surface substantially in the shape of a rectangle.

In the cushion member 102, cushion portions having different arrangement patterns of repulsive forces (relationship between regions divided in plan view and repulsive forces) are stacked in layers in the up-down direction. More specifically, in the cushion member 102, an upper cushion portion 121, a middle cushion portion 122 and a lower cushion portion 123 are stacked in layers so as to be sequentially aligned from above. In the cushion member 102, the cushion portions 121 to 123 of filament three-dimensional bonded members formed separately are stacked in the up-down direction. However, the cushion member 102 may be formed by integrally adhering or fusing the cushion portions 121 to 123.

Figure 5:
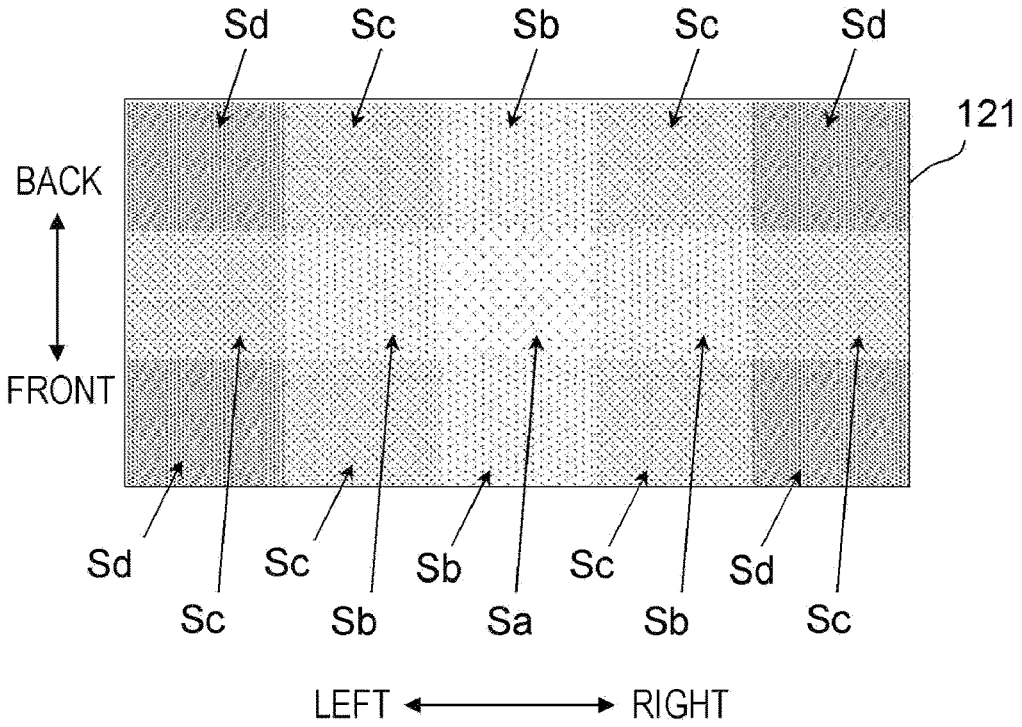
FIG. 5 is a schematic plan view of an upper cushion portion in the second embodiment.

In the upper cushion portion 121, as indicated by a colored state in FIG. 5, the arrangement pattern of repulsive forces is set. Specifically, the upper cushion portion 121 is divided into five equal portions in the left/right direction and is divided into three equal portions in the forward/backward direction so as to be divided into a total of 15 regions, and a center region thereof is set to a region Sa which has the lowest repulsive force. The four regions adjacent to the region Sa in the forward/backward direction and in the left/right direction are set to regions Sb which have a higher repulsive force than the region Sa. Furthermore, the four regions in four corners are set to regions Sd which have the highest repulsive force. The remaining six regions are set to regions Sc which have a higher repulsive force than the regions Sb and a lower repulsive force than the regions Sd.

Figure 6:
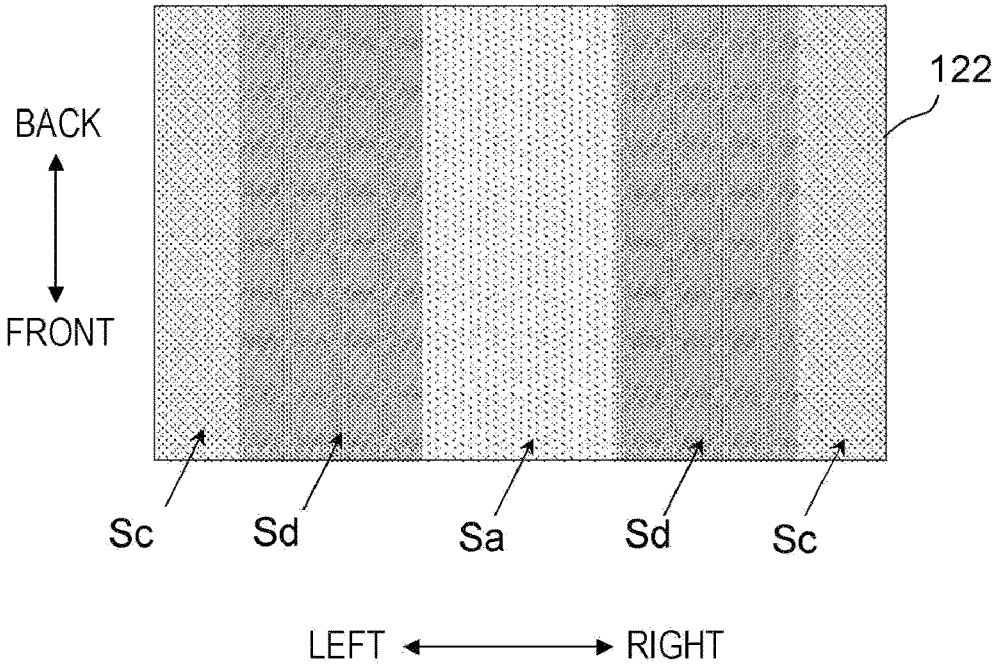
FIG. 6 is a schematic plan view of a middle cushion portion in the second embodiment.

In the middle cushion portion 122, as indicated by a colored state in FIG. 6, the arrangement pattern of repulsive forces is set. Specifically, the middle cushion portion 122 is divided into five portions in the left/right direction so as to be divided into a total of 5 regions, and the dimensions of regions at both ends in the left/right direction are about half of the dimensions of the other three regions in the left/right direction. The center region is set to a region Sa which has the lowest repulsive force, the regions adjacent thereto in the left/right direction are set to regions Sd which have the highest repulsive force and the regions at both ends in the left/right direction are set to regions Sc which have a lower repulsive force than the regions Sd.

Figure 7:
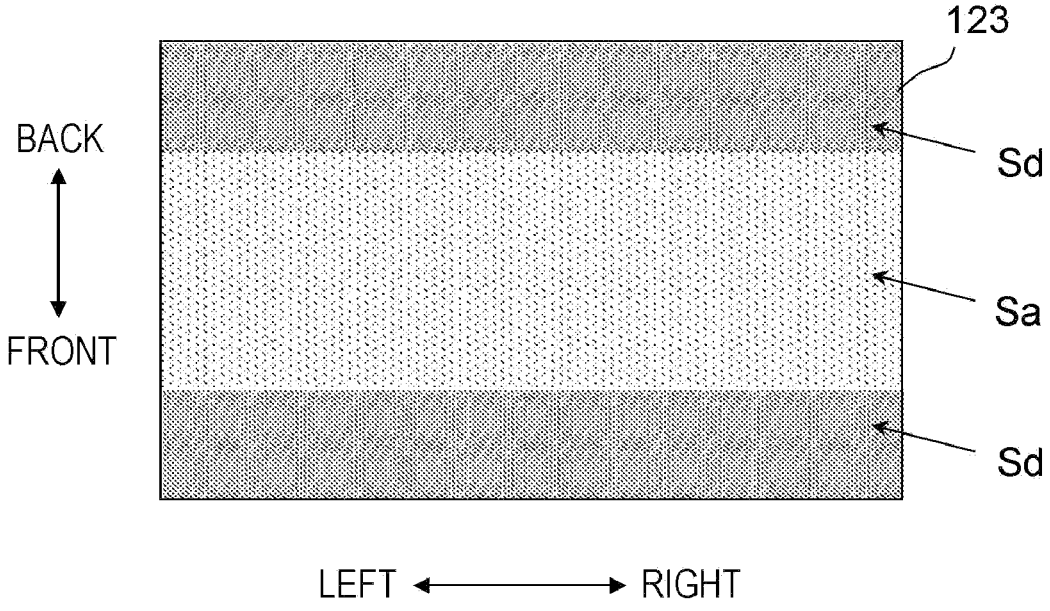
FIG. 7 is a schematic plan view of a lower cushion portion in the second embodiment.
Figure 8:
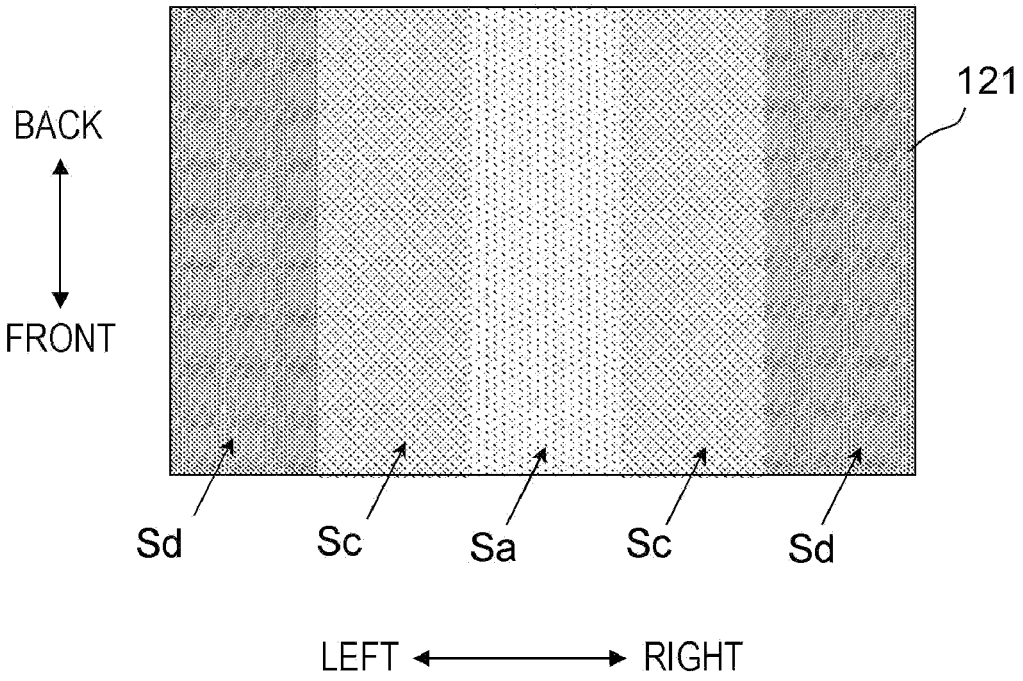
FIG. 8 is a plan view of a variation of the upper cushion portion in the second embodiment.

In the lower cushion portion 123, as indicated by a colored state in FIG. 7, the arrangement pattern of repulsive forces is set. Specifically, the lower cushion portion 123 is divided into three portions in the forward/backward direction so as to be divided into a total of 3 regions, and the dimensions of the regions at both ends in the forward/backward direction are about half of the dimension of the center region in the forward/backward direction. The center region is set to a region Sa which has the lowest repulsive force, and the regions adjacent thereto in the forward/backward direction are set to regions Sd which have the highest repulsive force. The repulsive forces of the cushion portions 121 to 123 are substantially uniform in the up-down direction.

The cushion member 102 includes the cushion portions 121 to 123 as described above, and in the entire cushion member 102, the repulsive forces in the regions on the sides of both ends in the left/right direction are higher than the repulsive force in the region of the center portion, and the repulsive forces in the regions on the sides of both ends in the forward/backward direction are higher than the repulsive force in the region of the center portion. Hence, the head position of the user can be stabilized as much as possible in a position near the center of the cushion member 102 in plan view, and thus the user can sleep comfortably.

Furthermore, in the cushion member 102, the cushion portions 121 to 123 having different arrangement patterns of repulsive forces are stacked in layers, and thus it is possible to give complex tactile sensations to the user. The specific arrangement pattern of repulsive forces in the cushion portions 121 to 123 may be changed variously, for example, according to the preferences of the user and the like. As an example, the arrangement pattern of the upper cushion portion 121 may be set as indicated by a colored state in FIG. 8. In this example, the upper cushion portion 121 is divided into five equal portions in the left/right direction, the center region is set to a region Sa which has the lowest repulsive force and the regions having higher repulsive forces are allocated toward both ends in the left/right direction.

Figure 3B:
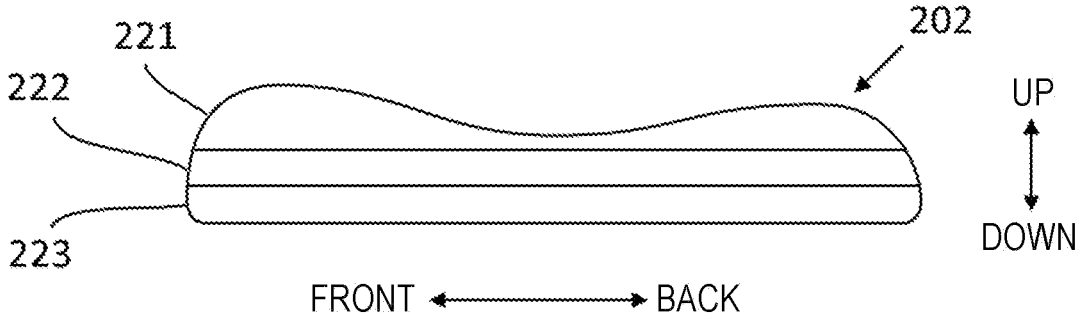
FIG. 3B is a front view of a variation of the cushion member according to the second embodiment.

FIG. 3B is a schematic front view of a cushion member 202 which is a variation of the cushion member 102 according to the second embodiment. In the cushion member 202, heights on the sides of both end portions in the forward/backward direction (depth direction) are higher than the height of a center portion, and a center region of the upper surface substantially in the shape of a rectangle is mainly used to support the head. In the cushion member 202, cushion portions having different arrangement patterns of repulsive forces (relationship between regions divided in plan view and repulsive forces) are stacked in layers in the up-down direction. More specifically, in the cushion member 202, an upper cushion portion 221, a middle cushion portion 222 and a lower cushion portion 223 are stacked in layers so as to be sequentially aligned from above. The arrangement pattern of repulsive forces in the upper cushion portion 221 is the same as in the upper cushion portion 121, the arrangement pattern of repulsive forces in the middle cushion portion 222 is the same as in the middle cushion portion 122 and the arrangement pattern of repulsive forces in the lower cushion portion 223 is the same as in the lower cushion portion 123. In the cushion member 202, the cushion portions 221 to 223 of filament three-dimensional bonded members formed separately are stacked in the up-down direction. However, the cushion member 202 may be formed by integrally adhering or fusing the cushion portions 221 to 223.

3. Third Embodiment

The third embodiment of the present invention will then be described. In the following description, emphasis is placed on the description of items different from the first embodiment, and description of items common to the first embodiment may be omitted.

Figure 9A:
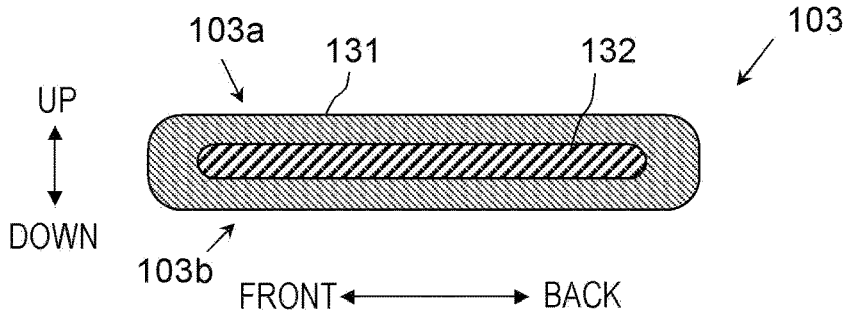
FIG. 9A is a schematic front view of a cushion member according to a third embodiment.

FIG. 9A is a schematic front view of a cushion member for a pillow 103 according to the third embodiment. As shown in the figure, the cushion member 103 is formed by inserting a second cushion portion 132 of a substantially rectangular parallelepiped into a first cushion portion 131 in which an upper surface 103*a* and a lower surface 103*b* are parts of side surfaces and which is formed in a tubular shape. More specifically, the first cushion portion 131 is formed in the shape of a tube with left and right portions serving as axes, and an internal space is opened both to a left side and a right side. However, the cushion portion 131 may be formed in the shape of a tube having a bottom with the left side or the right side of the internal space being closed or may be formed in the shape of a tube with the forward/backward direction serving as an axial direction instead of the left/right direction.

The cushion member 103 is formed to support the head of the user in a sleeping posture, and is mainly used to support the head with a center region of the upper surface substantially in the shape of a rectangle. The first cushion portion 131 and the second cushion portion 132 are filament three-dimensional bonded members which are formed separately.

Figure 10:
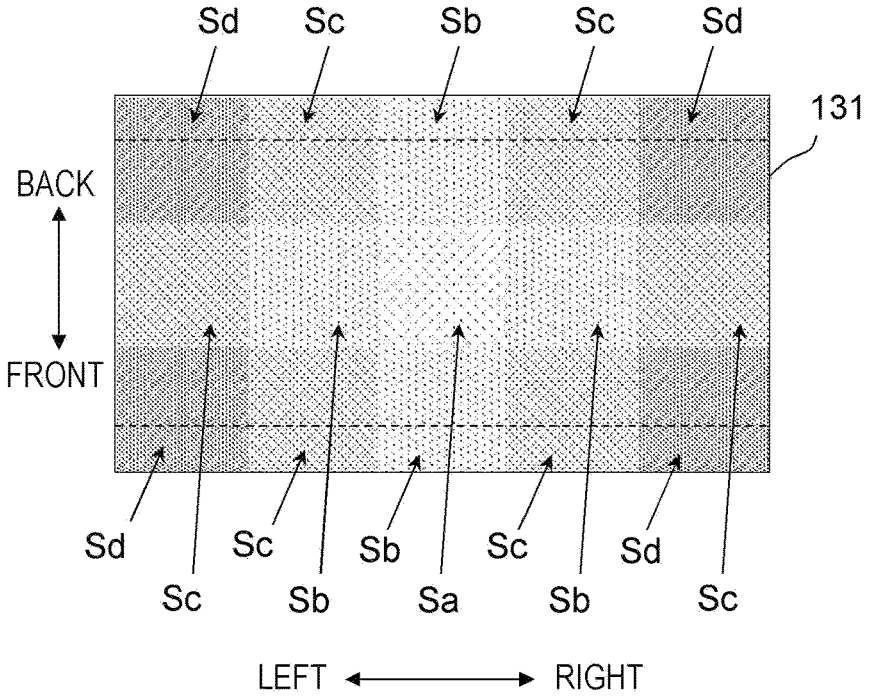
FIG. 10 is a schematic plan view of a main cushion member in the third embodiment.

FIG. 10 is a schematic plan view of the first cushion portion 131. In the first cushion portion 131, as indicated by a colored state in FIG. 10, the arrangement pattern of repulsive forces is set. Specifically, the first cushion portion 131 is divided into five equal portions in the left/right direction and three equal portions in the forward/backward direction so as to be divided into a total of 15 regions, and a center region thereof is set to a region Sa which has the lowest repulsive force. The four regions adjacent to the region Sa in the forward/backward direction and in the left/right direction are set to regions Sb which have a higher repulsive force than the region Sa. Furthermore, the four regions in four corners are set to regions Sd which have the highest repulsive force. The remaining six regions are set to regions Sc which have a higher repulsive force than the regions Sb and a lower repulsive force than the regions Sd. The repulsive force of the first cushion portion 131 is substantially uniform in the up-down direction.

Figure 11:
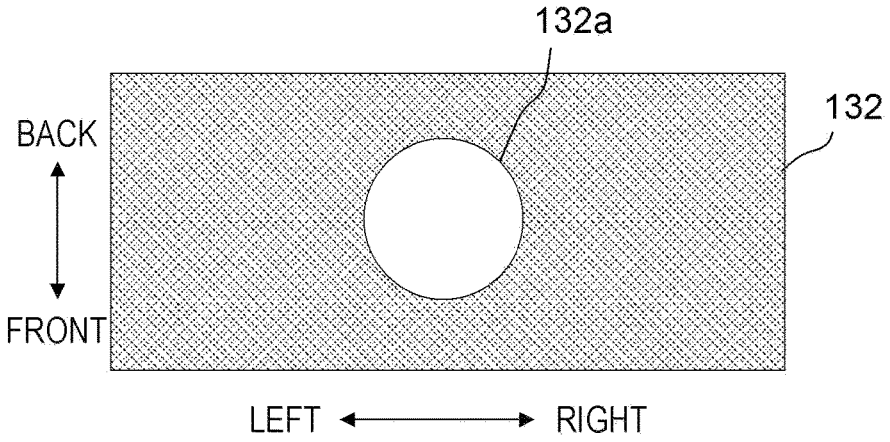
FIG. 11 is a schematic plan view of an auxiliary cushion member in the third embodiment.

FIG. 11 is a schematic plan view of the second cushion portion 132. The second cushion portion 132 is formed substantially in the shape of a plate such that the shape and the dimensions thereof are fitted into the internal space of the first cushion portion 131. Although as a whole, the repulsive force of the second cushion portion 132 is substantially uniform, a hole 132*a* is formed in a center position in plan view. The hole 132*a* may be a through hole or may be a recess having only the upper side opened.

In the cushion member 103 formed by inserting the second cushion portion 132 into the internal space of the first cushion portion 131, in a position corresponding to the hole 132*a*, a substantial repulsive force is decreased and the head of the user easily sinks. In this way, the head of the user can be made to easily settle into the head position. The size and the position of the hole 132*a* in the second cushion portion 132 may be adjusted as necessary according to the shape of the head of each user and the preference of the user.

Figure 9B:
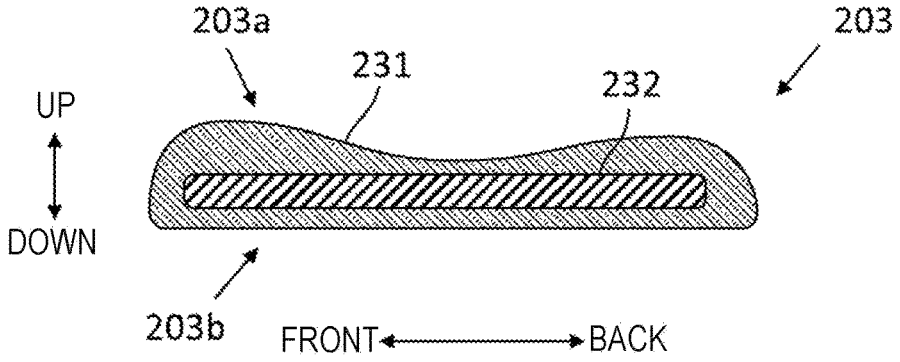
FIG. 9B is a front view of a variation of the cushion member according to the third embodiment.

FIG. 9B is a schematic front view of a cushion member 203 which is a variation of the cushion member 103 according to the third embodiment. As shown in the figure, the cushion member 203 is formed by inserting a second cushion portion 232 of a substantially rectangular parallelepiped into a first cushion portion 231 in which an upper surface 203*a* and a lower surface 203*b* are parts of side surfaces and which is formed in a tubular shape. More specifically, the first cushion portion 231 is formed in the shape of a tube with left and right portions serving as axes, an internal space is opened both to a left side and a right side and heights on the sides of both end portions in the forward/backward direction (depth direction) are higher than the height of a center portion. In the first cushion portion 231, in the width direction, repulsive forces in regions on the sides of both end portions are higher than a repulsive force in the region of a center portion, and in the depth direction, repulsive forces in regions on the sides of both end portions are higher than a repulsive force in the region of a center portion. In the second cushion portion 232, in the width direction, repulsive forces in regions on the sides of both end portions are higher than a repulsive force in the region of a center portion, and in the depth direction, repulsive forces in regions on the sides of both end portions are higher than a repulsive force in the region of a center portion. However, the first cushion portion 231 may be formed in the shape of a tube having a bottom with the left side or the right side of the internal space being closed or may be formed in the shape of a tube with the forward/backward direction serving as an axial direction instead of the left/right direction.

4. Filament Three-Dimensional Bonded Member Manufacturing Device and Method for Manufacturing Filament Three-Dimensional Bonded Member A description will then be given of a filament three-dimensional bonded member manufacturing device and a method for manufacturing a filament three-dimensional bonded member capable of being utilized as the cushion member 101 of the first embodiment and the cushion portions 121 to 123, 131 and 132 of the second and third embodiments (hereinafter also referred collectively to as a cushion member X) which have been described previously.

Figure 12:
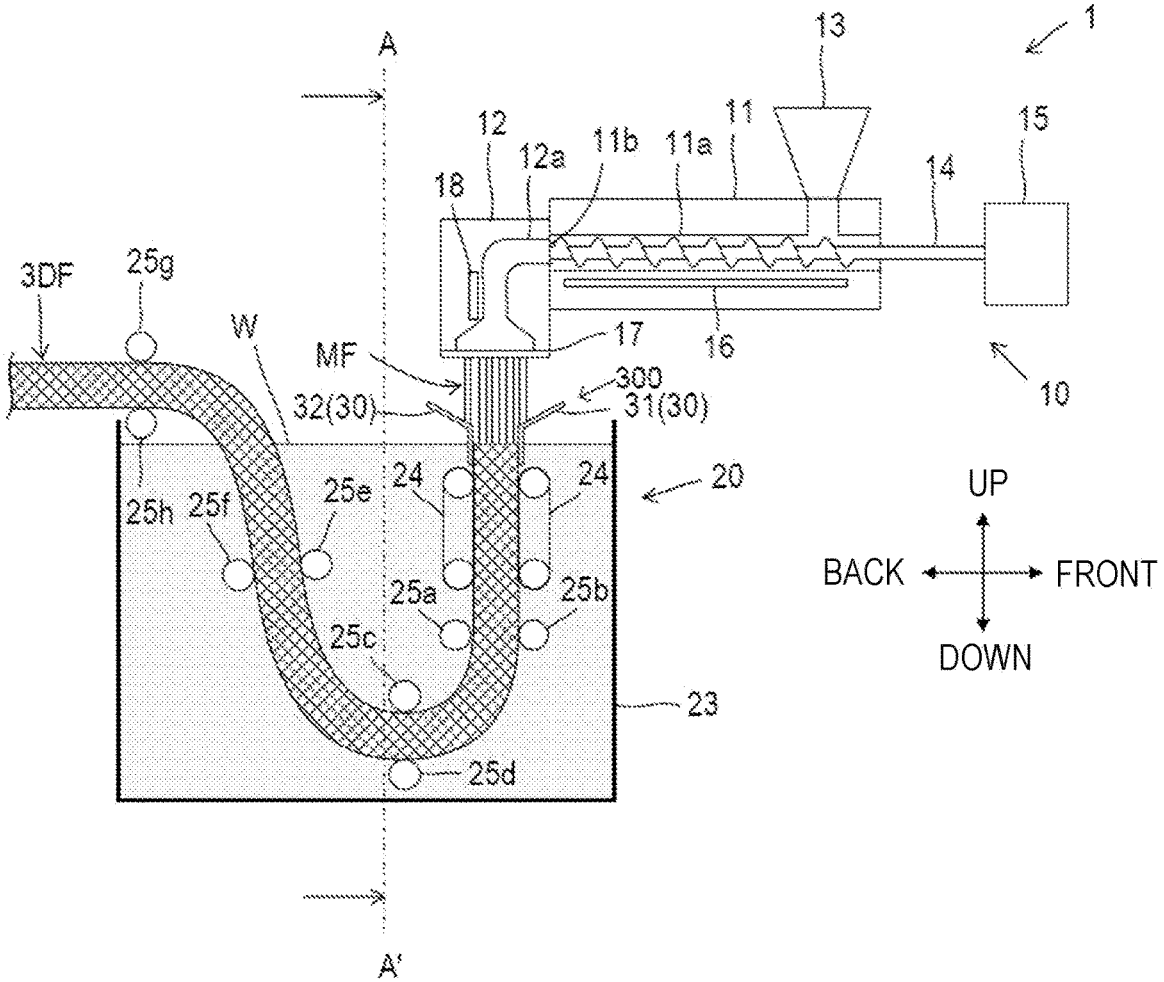
FIG. 12 is a configuration view of a filament three-dimensional bonded member manufacturing device.
Figure 13:
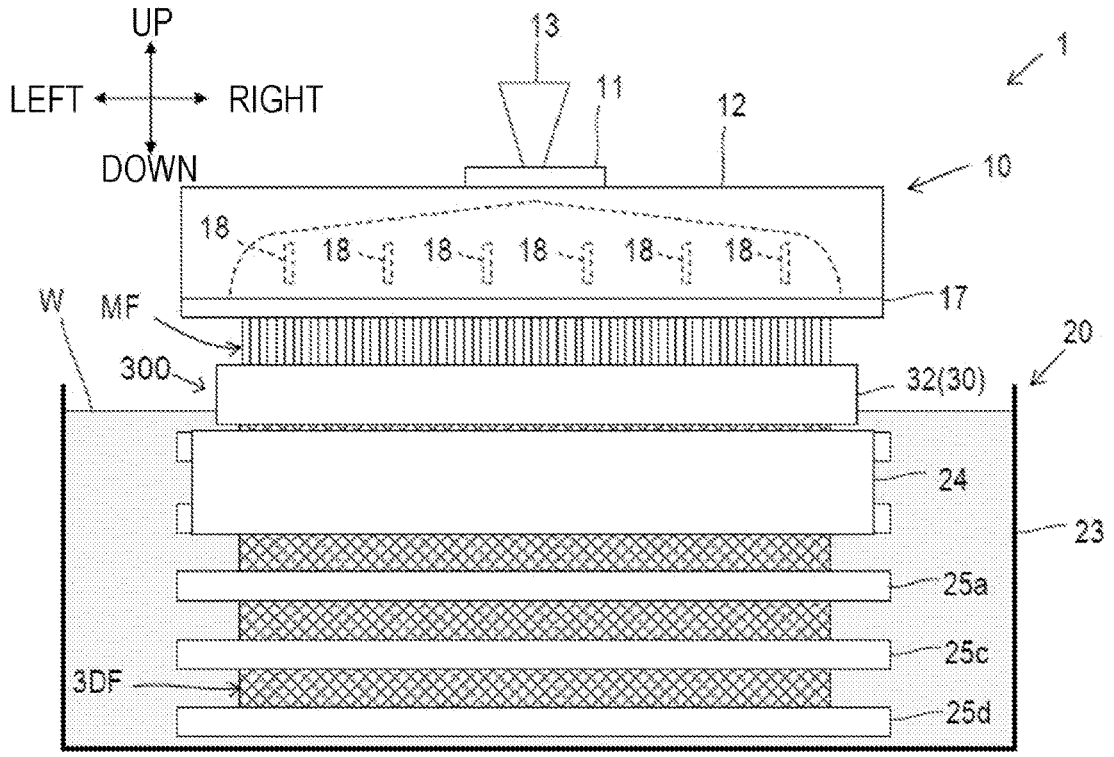
FIG. 13 is a cross section taken along line A-A' indicated by arrows and shown in FIG. 12.

FIG. 12 is a configuration view of the filament three-dimensional bonded member manufacturing device 1. FIG. 13 is a cross section taken along line A-A' indicated by arrows and shown in FIG. 12. For the manufacturing device 1, an up-down direction, a left/right direction and a forward/backward direction (which are orthogonal to each other) are as shown in these figures. These directions are only determined for convenience such that a vertical direction is the up-down direction, and a direction in which a pair of receiving plates described later are opposite each other is the forward/backward direction.

The filament three-dimensional bonded member manufacturing device 1 includes: a molten filament supply unit 10 which discharges, downward in the vertical direction, a molten filament group MF formed with a plurality of molten filaments having a diameter of mm to 3 mm; and a fusing formation unit 20 which three-dimensionally entangles the molten filament group MF to fuse contact points and thereafter cools and solidifies the molten filament group MF to form a filament three-dimensional bonded member 3DF.

The molten filament supply unit 10 includes a pressurization melting portion 11 (extruder) and a filament discharge portion 12 (die). The pressurization melting portion 11 includes a material input portion 13 (hopper), a screw 14, a screw motor 15 for driving the screw 14, a screw heater 16 and a plurality of unillustrated temperature sensors. Within the pressurization melting portion 11, a cylinder 11*a* is formed which transports a thermoplastic resin supplied from the material input portion 13 while heating and melting the thermoplastic resin with the screw heater 16.

Within the cylinder 11*a*, the screw 14 is rotatably stored. At an end portion of the cylinder 11*a* on a downstream side, a cylinder discharge port 11*b* for discharging the thermoplastic resin toward the filament discharge portion 12 is formed. A heating temperature for the screw heater 16 is controlled based on, for example, the detection signal of a temperature sensor provided in the molten filament supply unit 10.

The filament discharge portion 12 includes a nozzle portion 17, die heaters 18 and a plurality of unillustrated temperature sensors, and within the filament discharge portion 12, a guide flow path 12*a* is formed which guides, to the nozzle portion 17, the molten thermoplastic resin discharged from the cylinder discharge port 11*b*.

The nozzle portion 17 is a thick plate in which a plurality of opening are formed, which is formed substantially in the shape of a rectangular parallelepiped and which is made of metal, and is provided in a lower portion of the filament discharge portion 12 which is the most downstream portion of the guide flow path 12*a*. The openings formed in the nozzle portion 17 will be described later.

A plurality of (in an example shown in FIG. 13, six) die heaters 18 are provided in the left/right direction to heat the filament discharge portion 12. A heating temperature for the die heaters 18 is controlled based on, for example, the detection signal of a temperature sensor provided in the filament discharge portion 12.

Examples of the thermoplastic resin which can be used as the material of the filament three-dimensional bonded member include: polyolefin resins such as polyethylene and polypropylene; polyester resins such as polyethylene terephthalate; polyamide resins such as nylon 66; a polyvinyl chloride resin, a polystyrene resin and the like; and thermoplastic elastomers such as styrene elastomers, vinyl chloride elastomers, olefin elastomers, urethane elastomers, polyester elastomers, nitrile elastomers, polyamide elastomers and fluorine elastomers.

The thermoplastic resin supplied from the material input portion 13 is heated and melted within the cylinder 11*a* and is, for example, supplied as the molten thermoplastic resin from the cylinder discharge port 11*b* to the guide flow path 12*a* of the filament discharge portion 12 so as to be extruded by the screw 14. Thereafter, the molten filament group MF formed with a plurality of molten filaments is discharged downward in parallel from the openings in the nozzle portion 17.

The fusing formation unit 20 includes a cooling water tank 23, a pair of conveyors 24, a plurality of transport rollers 25*a* to 25*h* and a receiving portion 300. The receiving portion 300 includes a first receiving plate 31 and a second receiving plate 32. The first receiving plate 31 (receiving plate 30 on the front side) and the second receiving plate 32 (receiving plate 30 on the back side) are provided as a pair of front and back receiving plates 30, and functions to regulate the thickness and the width of the filament three-dimensional bonded member 3DF.

The cooling water tank 23 is a water tank for storing cooling water W. Within the cooling water tank 23, the pair of conveyors 24 and the transport rollers 25*a* to 25*h* are provided. The pair of conveyors 24*a* and 24*b* and the transport rollers 25*a* to 25*h* are driven by an unillustrated drive motor.

Figure 14:
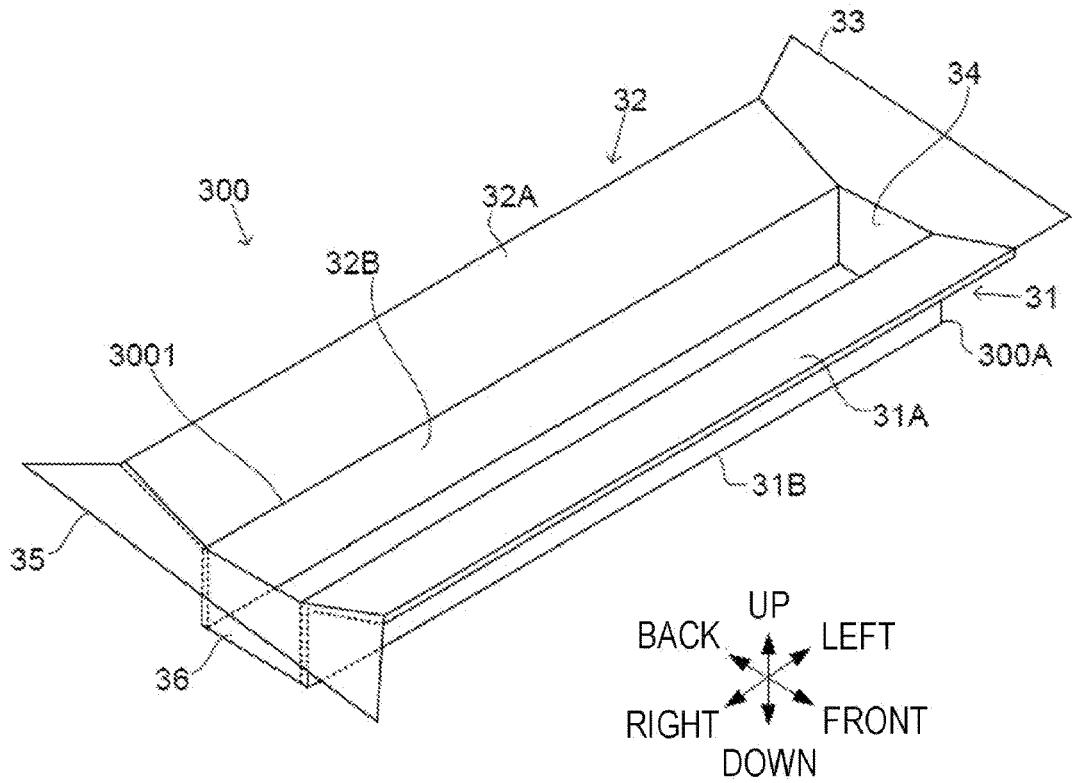
FIG. 14 is an illustrative view for the receiving portion of the manufacturing device.

FIG. 14 is a schematic perspective view of the receiving portion 300. The receiving portion 300 includes the first receiving plate 31, the second receiving plate 32, a third receiving plate 33, a first side plate 34, a fourth receiving plate 35 and a second side plate 36.

The first receiving plate 31 is a metal plate including a bent portion that includes: an inclination portion 31A which is inclined downward toward the back side and is formed in the shape of a flat plate; and a vertical portion 31B which extends from a lower end of the inclination portion 31A downward in the vertical direction and is formed in the shape of a flat plate. The second receiving plate 32 is a metal plate including a bent portion that includes: an inclination portion 32A which is inclined downward toward the front side and is formed in the shape of a flat plate; and a vertical portion 32B which extends from a lower end of the inclination portion 32A downward in the vertical direction and is formed in the shape of a flat plate. These vertical portions 31B and 32B are parallel to each other, and are opposite each other in the forward/backward direction.

The third receiving plate 33 is a metal plate which is fixed to the left ends of the inclination portions 31A and 32A by welding or the like, and is formed in the shape of a flat plate that is inclined downward toward the right side. The first side plate 34 is a metal plate which is fixed to the left ends of the vertical portions 31B and 32B and to the lower end of the third receiving plate 33 by welding or the like.

The fourth receiving plate 35 is a metal plate which is fixed to the right ends of the inclination portions 31A and 32A by welding or the like, and is formed in the shape of a flat plate that is inclined downward toward the left side. The second side plate 36 is a metal plate which is fixed to the right ends of the vertical portions 31B and 32B and to the lower end of the fourth receiving plate 35 by welding or the like. A tubular portion 300A in the shape of a rectangular parallelepiped is formed by the vertical portions 31B and 32B, the first side plate 34 and the second side plate 36. The size of the interior of the tubular portion 300A in the forward/backward direction and the left/right direction is set according to the size of the cushion member to be manufactured in the up-down direction and the left/right direction.

Figure 15:
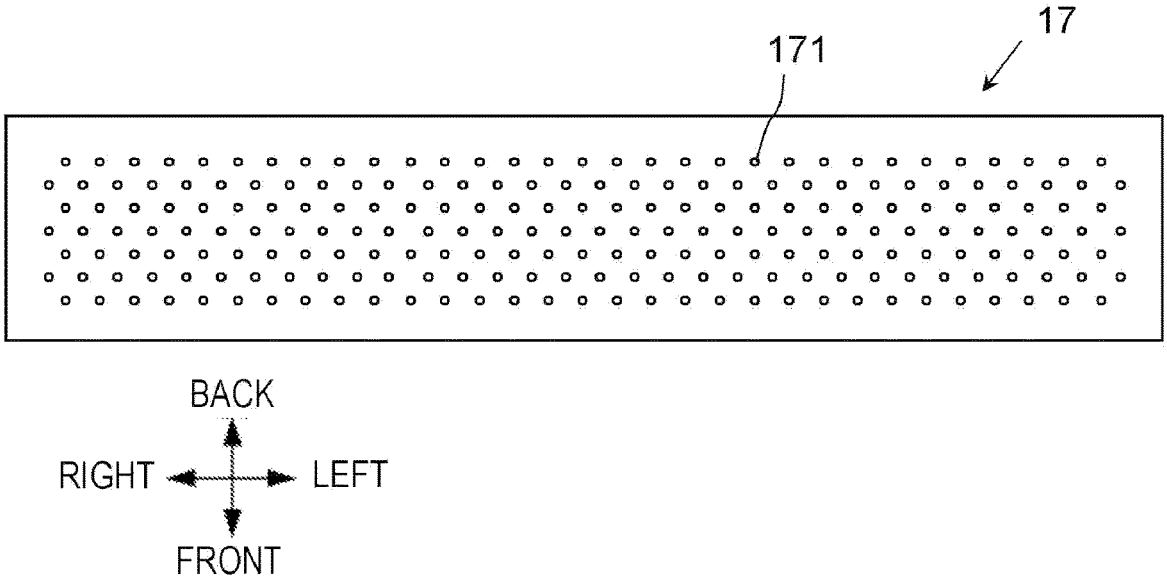
FIG. 15 is an illustrative view for the nozzle portion of the manufacturing device.

FIG. 15 is a bottom view of the nozzle portion 17 viewed from below. In the nozzle portion 17, a plurality of openings 171 for discharging the molten filament group are formed. The openings 171 are aligned in the left/right direction to form a row, and the rows described above are aligned in the forward/backward direction to form a staggered arrangement as a whole. The cross-sectional shape of the opening 171 is, for example, a circle having an inside diameter of 1 mm. The number, the arrangement and the like of the openings 171 shown in FIG. 15 are only examples. The size of a region where the openings 171 are arranged in the nozzle portion 17 in the forward/backward direction and the left/right direction is set substantially equal to or slightly larger than the size of the tubular portion 300A in the forward/backward direction and the left/right direction.

The molten filament group MF discharged from the nozzle portion 17 proceeds to the cooling water tank 23 via the receiving portion 300 (inside of the tubular portion 300A), and bends due to the buoyancy action of the cooling water W in the cooling water tank 23 to form random loops. The random loops adjacent to each other are three-dimensionally entangled in a molten state, contact points are fused and thus a three-dimensional filament bonded member is formed.

Thereafter, the bonded member is transported by the conveyors 24 and the transport rollers 25*a* to 25*h* while being cooled by the cooling water W in the cooling water tank 23, and thus the bonded member is discharged as the filament three-dimensional bonded member 3DF to the outside of the cooling water tank 23. When attention is particularly focused on the vicinity of the receiving portion 300, the manufacturing device 1 cools and fuses the molten filament group MF discharged from the openings 171 and draws the molten filament group MF which has been fused in the transport direction (here, downward) of the bonded member.

The filament three-dimensional bonded member 3DF continuously formed in the transport direction in this way is cut into predetermined lengths, and can be applied as the cushion member X described above. The operating speed (rotational speed) of the conveyors 24 and the transport rollers 25*a* to 25*h* is controlled by an unillustrated controller, and thus the operating speed can be changed as necessary.

Here, the width direction (corresponding to the left/right direction of FIG. 12) of the filament three-dimensional bonded member 3DF corresponds to the width direction of the cushion member X. The thickness direction (corresponding to the forward/backward direction of FIG. 12) of the filament three-dimensional bonded member 3DF corresponds to the height direction of the cushion member X. The transport direction of the filament three-dimensional bonded member 3DF in the fusing formation unit 20 corresponds to the depth direction of the cushion member X.

Hence, in order to manufacture the cushion member X in which repulsive forces are changed in the depth direction, when the filament three-dimensional bonded member 3DF is manufactured by the manufacturing device 1, the operating speed of the conveyors 24 and the transport rollers 25*a* to 25*h* is preferably changed to change the speed of the drawing of the bonded member in the transport direction. As the operating speed is increased, the molten filament group MF immediately after proceeding to the cooling water tank 23 is drawn downward more quickly, and accordingly, the number of filaments per unit volume of the filament three-dimensional bonded member 3DF corresponding to this part is decreased, with the result that the repulsive forces are lowered. By contrast, as the operating speed is decreased, the molten filament group MF immediately after proceeding to the cooling water tank 23 is drawn downward more slowly, and accordingly, the number of filaments per unit volume of the filament three-dimensional bonded member 3DF corresponding to this part is increased, with the result that the repulsive forces are increased.

For example, in a case where the lower cushion portion 123 shown in FIG. 7 is manufactured, the operating speed of the conveyors 24 and the transport rollers 25*a* to 25*h* is relatively decreased, and thus the parts of the regions Sd of the cushion member X can be formed whereas the operating speed is relatively increased, and thus the part of the region Sa of the cushion member X can be formed. The operating speed is alternately switched, and thus the parts of the regions Sd of the cushion member X and the part of the region Sa of the cushion member X can be alternately formed.

In order to manufacture the cushion member X in which repulsive forces are changed in the width direction, when the filament three-dimensional bonded member 3DF is manufactured by the manufacturing device 1, the number of openings 171 formed in the nozzle portion 17 is preferably adjusted. As the number of openings 171 in a predetermined region of the nozzle portion 17 is decreased (that is, the density of the openings 171 is decreased), the number of filaments per unit volume of the filament three-dimensional bonded member 3DF corresponding to this region is decreased, with the result that the repulsive forces are lowered. By contrast, as the number of openings in the predetermined region of the nozzle portion 17 is increased (that is, the density of the openings 171 is increased), the number of filaments per unit volume of the filament three-dimensional bonded member 3DF corresponding to this region is increased, with the result that the repulsive forces are increased. Instead of adjusting the density of the openings 171 (or in addition to the adjustment of the density of the openings 171), the diameter of the openings 171 may be adjusted. In this case, as the diameter of the openings 171 is increased, the diameter of the filaments is increased, with the result that the repulsive forces are increased. By contrast, as the diameter of the openings 171 is decreased, the diameter of the filaments is decreased, with the result that the repulsive forces are lowered. The diameter or the density of the openings 171 is changed in each of different regions of the nozzle portion 17, and thus it is possible to easily manufacture the cushion member in which repulsive forces are changed in the width direction.

Figure 16:
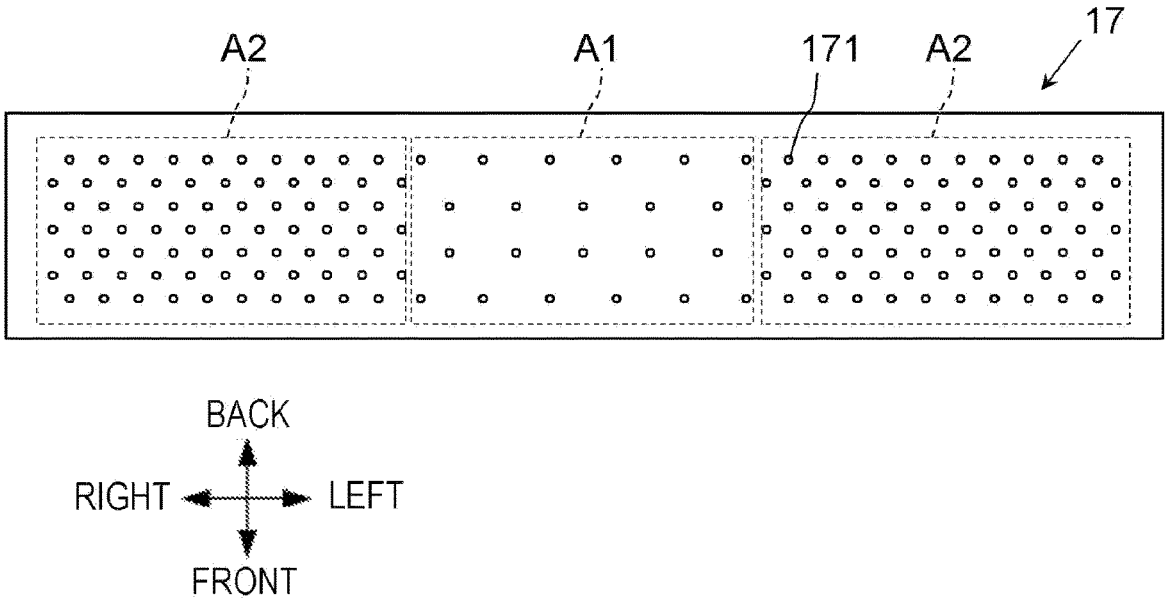
FIG. 16 is an illustrative view for the nozzle portion of the manufacturing device.
Figure 17:
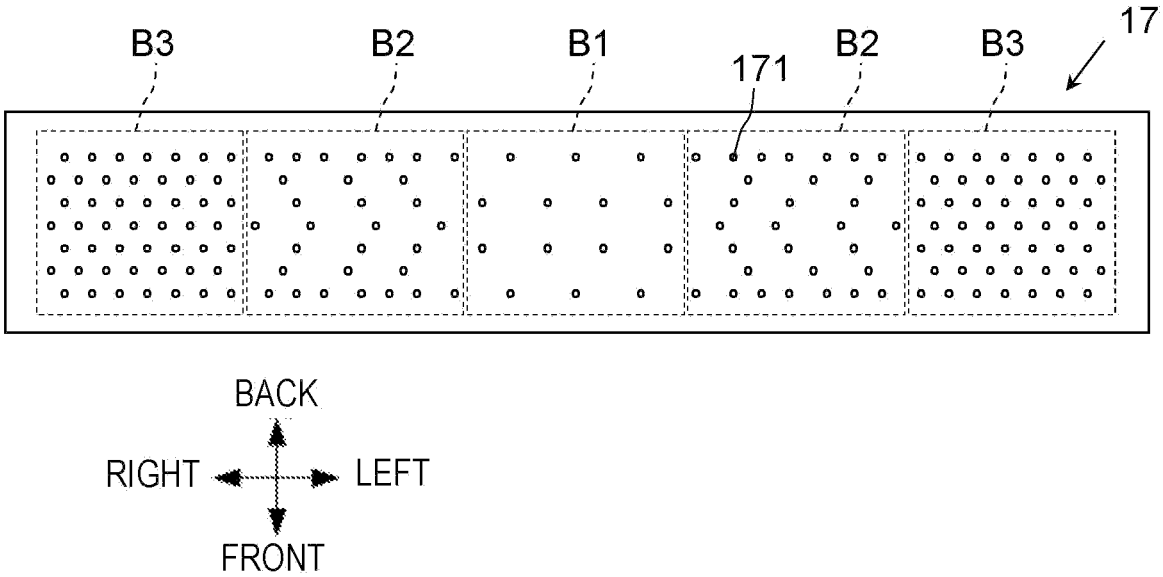
FIG. 17 is an illustrative view for the nozzle portion of the manufacturing device.

In an example, when the openings 171 in the nozzle portion 17 are provided as shown in FIG. 16, in a center region of the cushion member X in the left/right direction (region corresponding to a region A1 in which the number of openings 171 is low), a repulsive force is lower than repulsive forces in both end regions in the left/right direction (regions corresponding to regions A2 in which the number of openings 171 is high). When the openings 171 in the nozzle portion 17 are provided as shown in FIG. 17, in a center region of the cushion member X in the left/right direction (region corresponding to a region B1 in which the number of openings 171 is the lowest), a repulsive force is the lowest, in both end regions in the left/right direction (regions corresponding to regions B3 in which the number of openings 171 is the highest), repulsive forces are the highest and in regions (regions corresponding to regions B2) therebetween, repulsive forces are higher than the repulsive force in the center region in the left/right direction and are lower than the repulsive forces in both end regions in the left/right direction. When the nozzle portion 17 shown in FIG. 17 is used, as in the upper cushion portion 121 shown in FIG. 8, it is possible to manufacture the cushion member X in which repulsive forces are increased in three stages from the center region to each of both end regions in the left/right direction.

Preferably, in a case where as with the cushion member 101 shown in FIG. 1 and the upper cushion portion 121 shown in FIG. 5, the cushion member X in which repulsive forces are changed both in the forward/backward direction and in the left/right direction is manufactured, the nozzle portion 17 shown in FIG. 17 is used, and the operating speed of the conveyors 24 and the transport rollers 25*a* to 25*h* is changed. In this case, the operating speed of the conveyors 24 and the transport rollers 25*a* to 25*h* is relatively decreased, and thus the part of the cushion member X in which the regions Sd, Sc, Sb, Sc and Sd are sequentially aligned in the left/right direction can be formed, and the operating speed is relatively increased, and thus the part of the cushion member X in which the regions Sc, Sb, Sa, Sb and Sc are sequentially aligned in the left/right direction can be formed. The operating speed is alternately switched, and thus the part of the cushion member X in which the regions Sd, Sc, Sb, Sc and Sd are sequentially aligned in the left/right direction and the part of the cushion member X in which the regions Sc, Sb, Sa, Sb and Sc are sequentially aligned in the left/right direction can be alternately formed.

As a method for manufacturing the cushion member X having an internal cavity as with the first cushion portion 131 shown in FIG. 9A, a method can be adopted in which a normal cushion member (without a cavity) is first formed and processing for providing a cavity in the cushion member (for example, processing for cutting out a part corresponding to the cavity) is additionally performed. As another method for manufacturing the cushion member X having an internal cavity, a method may be adopted in which the openings 171 in the position of the nozzle portion 17 corresponding to the cavity are closed, thus the filaments are prevented from being discharged from these openings 171 and consequently, the cavity is provided.

Figure 18:
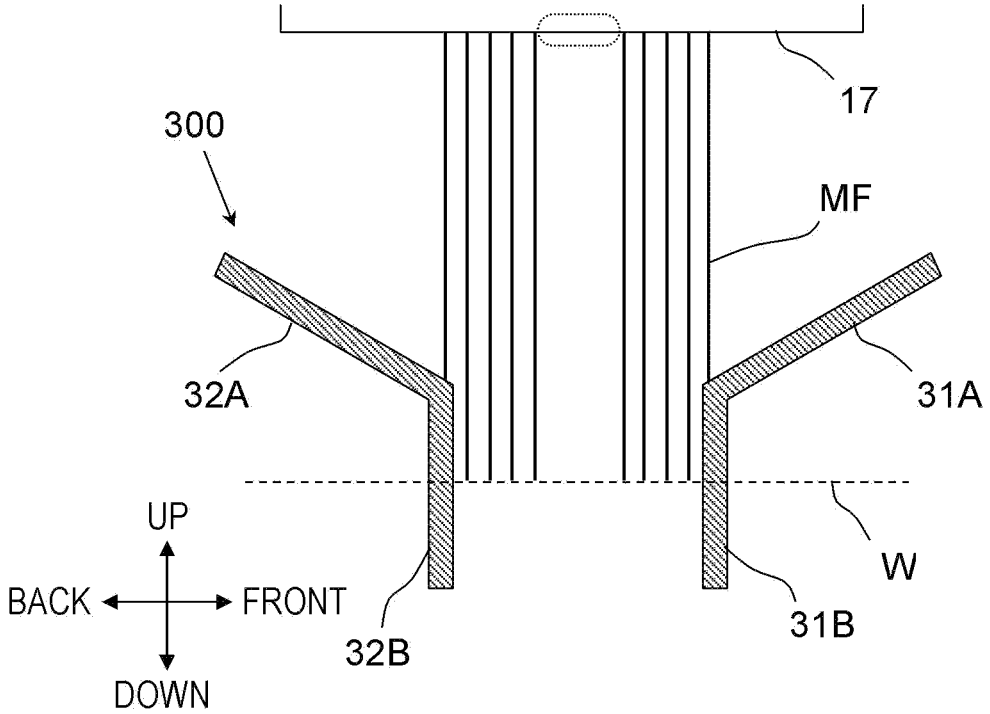
FIG. 18 is an illustrative view for a state around the receiving portion of the manufacturing device.

FIG. 18 illustrates a state around the receiving portion 300 when the filaments are prevented from being discharged from the openings 171 in the position (position indicated by a dotted frame in the figure) corresponding to the cavity. The cushion member having the cavity is formed as shown in FIG. 18, and thereafter, in order to adjust the shape, the size and the like of the cavity to the desired state, necessary processing may be further performed.

5. Others

The cushion members 101 to 103 of the embodiments described above are cushion members for a pillow which are formed to support the head of the user in a sleeping posture, and the repulsive forces in the regions on the sides of both end portions are higher than the repulsive force in the region of the center portion in the width direction. Hence, in the cushion members 101 to 103, although the head of the user is sunk moderately due to the cushioning property thereof, the repulsive forces at the end portions in the width direction are relatively high, and thus the unintended movement of the head from the center portion to the end portions in the width direction is suppressed as much as possible, with the result that the head position can be stabilized in the center portion in the width direction. In particular, in the cushion members 101 to 103 of the embodiments, the repulsive forces in the regions on the sides of both end portions are higher than the repulsive force in the region of the center portion in the width direction, and thus it is possible to further stabilize the head position in the center portion in the width direction.

Furthermore, in the cushion members 101 to 103 of the embodiments, the repulsive forces in the regions on the sides of both end portions are higher than the repulsive force in the region of the center portion in the depth direction. Hence, in the cushion members 101 to 103, an area around the cervical spine of the user can be appropriately supported by the part having a relatively high repulsive force. In particular, in the cushion members 101 to 103 of the embodiments, the repulsive forces in the regions on the sides of both end portions are higher than the repulsive force in the region of the center portion in the depth direction, and thus even when the cushion members 101 to 103 are arranged in the opposite direction with respect to the forward/backward direction, the area around the cervical spine of the user can be appropriately supported.

The above-described method for manufacturing the cushion member with the manufacturing device 1 includes: a molten filament supply processing step of discharging the molten filament group MF downward from a plurality of openings 171 in the nozzle portion 17; and a fusing formation processing step of cooling and fusing the molten filament group MF discharged and drawing the bonded member obtained by the fusing downward. In the manufacturing method described above, the diameter or the density of the openings 171 is changed in each of different regions of the nozzle portion 17 and the speed of the drawing is changed at a predetermined time interval such that the repulsive force is changed in each of different regions of the cushion member. In this way, it is possible to easily manufacture the cushion member in which repulsive forces are changed both in the width direction and in the depth direction.

Although the embodiments of the present invention have been described above, the configuration of the present invention is not limited to the embodiments described above, and various changes can be added without departing from the spirit of the present invention. In other words, the embodiments described above should be considered to be illustrative in all respects and not restrictive. It should be understood that the technical scope of the present invention is indicated not by the description of the above embodiments but by the scope of claims, and meanings equivalent to the scope of claims and all changes in the scope are included in the technical scope.

INDUSTRIAL APPLICABILITY

The present invention can be utilized for pillows and the like used during sleep.

REFERENCE SIGNS LIST

1 filament three-dimensional bonded member manufacturing device
10 molten filament supply unit
11 pressurization melting portion
11*a* cylinder
11*b* cylinder discharge port
12 filament discharge portion
12*a* guide flow path
13 material input portion
14 screw
15 screw motor
16 screw heater
17 nozzle portion
171 opening
18 die heater
20 fusing formation unit
23 cooling water tank
24 conveyor
25*a* to 25*h* transport rollers
300 receiving portion
31 first receiving plate
32 second receiving plate
33 third receiving plate
34 first side plate
35 fourth receiving plate
36 second side plate
101 to 103 cushion members
121 upper cushion portion
122 middle cushion portion
123 lower cushion portion
131 first cushion portion
132 second cushion portion

What is claimed is:

1. A cushion member for a pillow which is formed using a filament three-dimensional bonded member obtained by three-dimensionally fusing filaments formed of a thermoplastic resin, wherein in a width direction, repulsive forces in regions on sides of both end portions are higher than a repulsive force in a region of a center portion, and in a depth direction, repulsive forces in regions on sides of both end portions are higher than a repulsive force in a region of a center portion, the cushion member is formed by inserting a second cushion portion into a first cushion portion which is formed in a substantially tubular shape.

2. The cushion member according to claim 1, wherein at least two types of cushion portions include:

a cushion portion in which in a width direction, repulsive forces in regions on sides of both end portions are higher than a repulsive force in a region of a center portion; and a cushion portion in which in a depth direction, repulsive forces in regions on sides of both end portions are higher than a repulsive force in a region of a center portion, and the at least two types of cushion portions are stacked in layers in an up-down direction.

3. A method for manufacturing the cushion member according to claim 1 of the filament three-dimensional bonded member, the method comprising:

a molten filament supply processing step of discharging a molten filament group downward from a plurality of openings in a nozzle portion; and a fusing formation processing step of cooling and fusing the molten filament group discharged and drawing a bonded member obtained by the fusing in a transport direction, wherein a diameter or a density of the openings is changed in each of different regions of the nozzle portion and a speed of the drawing is changed at a predetermined time interval such that a repulsive force is changed in each of different regions of the cushion member.

* * * * *